US006336351B1

(12) United States Patent
Kobayashi et al.

(10) Patent No.: US 6,336,351 B1
(45) Date of Patent: Jan. 8, 2002

(54) METHOD OF MANUFACTURING SPLINE SHAFT

(75) Inventors: Akio Kobayashi, Kawachi-machi; Katsuyuki Morozumi, Utsunomiya, both of (JP)

(73) Assignee: Mitsubishi Steel Mfg. Co., Ltd., Tokyo (JP)

( * ) Notice: Subject to any disclaimer, the term of this patent is extended or adjusted under 35 U.S.C. 154(b) by 385 days.

(21) Appl. No.: 08/842,990

(22) Filed: Dec. 20, 1996

(30) Foreign Application Priority Data

Apr. 12, 1996 (JP) ..... 8-091125

(51) Int. Cl.[7] ..... B21K 1/30
(52) U.S. Cl. ..... 72/370.21; 72/356
(58) Field of Search ..... 72/356, 367.1, 72/370.21; 29/893.34, DIG. 49

(56) References Cited

U.S. PATENT DOCUMENTS 1,993,842 A * 3/1935 Jasper ..... 29/DIG. 49
2,713,277 A * 7/1955 Kaul ..... 29/893.34
2,883,744 A * 4/1959 Barnhart ..... 72/358
3,021,596 A * 2/1962 Yowell et al. ..... 72/370.07
4,594,874 A * 6/1986 Bononi et al. ..... 72/356

FOREIGN PATENT DOCUMENTS

JP 168627 * 7/1987 ..... 29/893.34
JP 06-297071 10/1994

OTHER PUBLICATIONS

The Making, Shaping and Treating of Steel 7th Edition, United States Steel Corporation, pp 385–386 & 821–822, 1957.*

* cited by examiner

*Primary Examiner*—Lowell A. Larson
(74) *Attorney, Agent, or Firm*—Flynn, Thiel, Boutell & Tanis, P.C.

(57) ABSTRACT

A method of manufacturing a spline shaft, comprising ironing a hollow stock by cold forging and forming splines in a desired portion of said hollow stock by cold forging by using its work harden state. This method makes it possible to reduce the weight of a product by using a hollow stock, and to prevent buckling of the material of the hollow stock during the formation of splines owing to work-hardening caused by the ironing. Further, a predetermined root strength can be ensured without requiring induction hardening. Accordingly, a reduction in weight is achieved, and the production speed and yield are improved.

4 Claims, 2 Drawing Sheets

METHOD OF MANUFACTURING SPLINE SHAFT

BACKGROUND OF THE INVENTION

1. Field of the Invention

The present invention particularly relates to a method of manufacturing a long spline shaft which constitutes a propeller shaft for an automobile.

2. Description of the Prior Art

Conventionally, the following method has been adopted to manufacture a long spline shaft. Specifically, a solid stock is hot-forged to form a rough shape from which to form splines, and after the solid blank formed into the rough shape is cut, a spline portion is worked by a hobbing machine. Then, the root strength of the spline portion is increased by induction hardening.

The conventional manufacturing method using the aforesaid machining has the problems of a long working time and low productivity because general spline shafts are long. In addition, to impart sufficient strength to the roots of a splines, it is necessary to use a solid stock and induction hardening.

Although there is a method of forming splines by cold forging, there is a risk of buckling.

SUMMARY OF THE INVENTION

The present invention is intended to reduce the weight of a spline shaft by using a hollow stock, to prevent buckling during the formation of splines by omitting softening following ironing by using cold forging and to improve productivity by omitting induction hardening, as well as to provide a spline shaft having sufficient strength.

The present invention provides a method of manufacturing a spline shaft, which comprises ironing a hollow stock by cold forging and forming splines in a desired portion of the hollow stock by cold forging by using its work hardening.

Specifically, the present invention makes it possible to reduce the weight of a product by using a hollow stock, and to prevent buckling of the material of the hollow stock by bringing the entire hollow stock into a work-hardened state by ironing it by cold forging before formation of splines and then forming a spline portion by cold forging without performing softening, as well as to obtain a predetermined root strength without requiring induction hardening. Accordingly, a reduction in weight is achieved, and the production speed and yield are improved.

The present invention is mainly directed to a long spline shaft for a propeller shaft of an automobile, and can also be applied to spline shafts for other machines which need transmission of power through a large area, such as airplane components, ship components, construction machinery and agricultural machinery.

DETAILED DESCRIPTION OF THE PREFERRED EMBODIMENTS

In ironing by cold forging according to the present invention, a hollow stock is subjected to bonderizing, and a load is applied to the hollow stock, for example, by a hydraulic press, to reduce the inner or outer diameter of the hollow stock. The ironing rate is determined according to the spline formability required in the next working step. In the forming and working of a spline portion by cold forging, the spline portion is worked to have a required length, such as by a hydraulic press.

EXAMPLE

A specific example of a long spline shaft which is a constituent element of a propeller shaft for an automobile will be described below with reference to the accompanying drawings.

Figure 1:
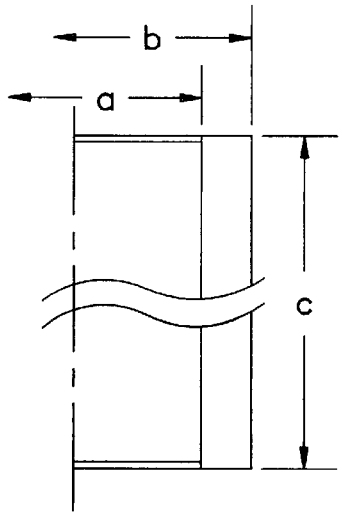
FIG. 1 is an explanatory view of the shape of a hollow stock to be used in Example.
Figure 2:
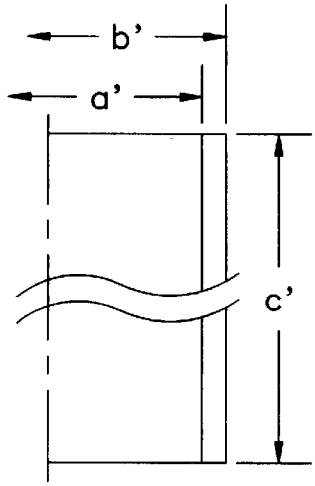
FIG. 2 is an explanatory view of the shape of a sample I after ironing.
Figure 3:
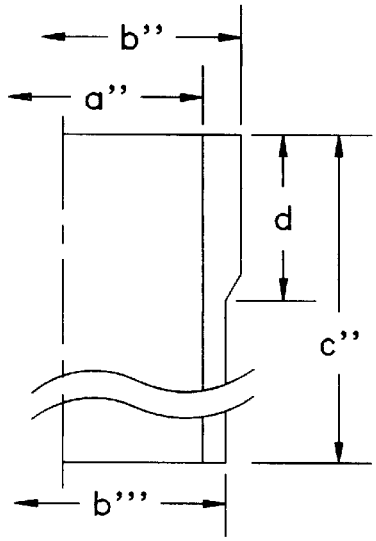
FIG. 3 is an explanatory view of the shape of a sample II after working which precedes the splining of the sample I.
Figure 4:
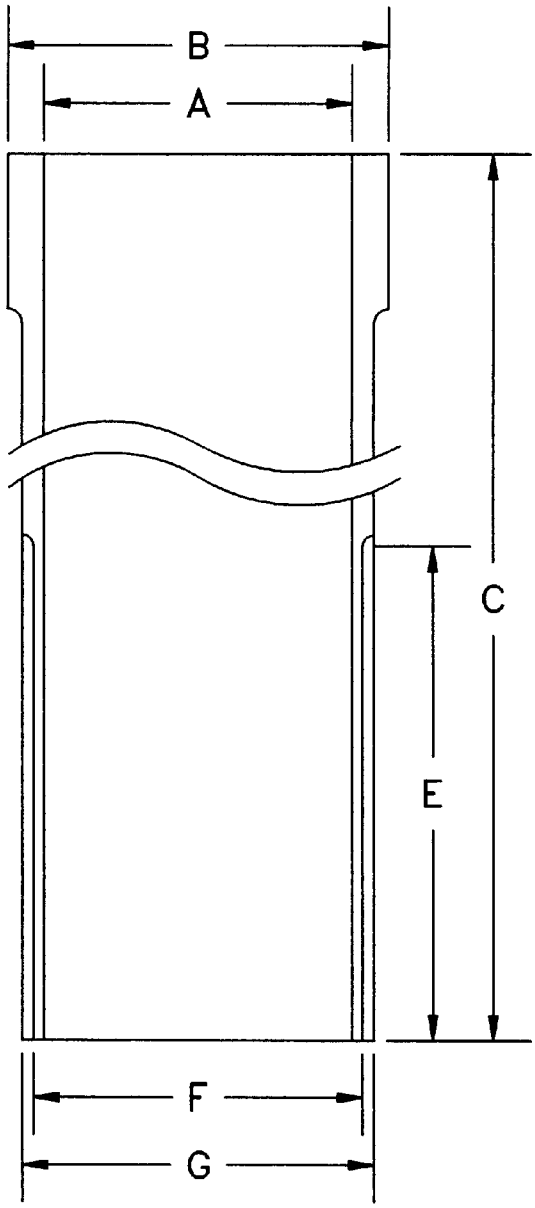
FIG. 4 is an explanatory view of the shape of a product.
Figure 5:
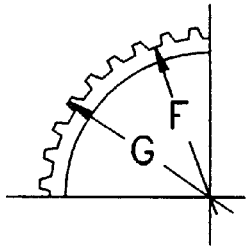
FIG. 5 is an explanatory view of a spline portion.

To improve the yield, a hollow stock having the shape shown in FIG. 1 (diameter a=75 mm, diameter b =103 mm, length c=105 mm) and made of a material of S43C specified in JIS (Japanese Industrial Standard) G4051 was subjected to bonderizing, and the obtained hollow stock was forward-extruded by cold forging while a forming load of 400 T was being applied to the hollow stock by a hydraulic press of 1,250 T, thereby providing a sample I having the shape shown in FIG. 2 (diameter a'=75 mm, diameter b=90 mm, length c'=211 mm). This sample I was subjected to softening and bonderizing and then a forming load of 200 T was applied to the sample I by a hydraulic press of 1,250 T, thereby providing a sample II having the shape shown in FIG. 3 (diameter a"=72 mm, diameter b"=90 mm, diameter b'"=84 mm, length c"=257 mm). This sample II was subjected to bonderizing without softening, and then a forming load of 200 T was applied to the sample II by a hydraulic press of 1,250 T, to form splines in a predetermined outer circumferential portion of the sample II, thereby providing a long spline shaft shown in FIG. 4. The obtained long spline shaft was a product of diameter A =72 mm, diameter B=90 mm, length C=282 mm, E (the length of its spline portion) =130 mm. FIG. 5 shows a fragmentary cross section of the spline portion of diameter F=79.2 mm, diameter G=84 mm.

The tests of the shaping degree and strength of the splines of each of the obtained products showed the completely same results as those of conventional products having the same shape subjected to machining by a hobbing machine and induction hardening in a hobbing machine.

In accordance with the present invention, since a hollow stock is formed into a product, a product of a reduced weight can be produced, and yield and productivity are improved owing to cold forging. By appropriately controlling the relation between the inner and outer diameters of the hollow stock and those of an ironed product, it is possible to freely control the working degree and shape of the splines. Buckling is prevented during the formation of splines owing to work-hardening caused by ironing by cold forging before the formation of the splines, so that the surface pressure is increased to improve the precision of the shapes of the splines and the strength thereof. In addition, unlike the prior art, since there is no need for softening before the formation of splines or induction hardening after the formation of splines, the number of process steps and costs can be reduced.

What is claimed is:

1. A method of manufacturing a spline shaft comprising the steps of:

providing a hollow stock;

ironing the hollow stock by cold forging to reduce the wall thickness of the hollow stock without substantially changing the internal diameter thereof and form a work-hardened hollow stock; and cold forging the work-hardened hollow stock to form the spline shaft.

2. The method of claim 1, consisting essentially of the described steps.

3. The method of claim 1, wherein the hollow stock is cold forged by extrusion.

4. The method of claim 1, wherein the splines are formed on an outer surface of the hollow stock.

* * * * *